US010236117B2

(12) United States Patent
Hori

(10) Patent No.: US 10,236,117 B2
(45) Date of Patent: Mar. 19, 2019

(54) IGNITION COIL FOR INTERNAL-COMBUSTION ENGINE

(71) Applicant: HITACHI AUTOMOTIVE SYSTEMS HANSHIN, LTD., Kobe-shi, Hyogo (JP)

(72) Inventor: Masaaki Hori, Kobe (JP)

(73) Assignee: HITACHI AUTOMOTIVE SYSTEMS HANSHIN, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/736,836

(22) PCT Filed: Jun. 16, 2016

(86) PCT No.: PCT/JP2016/002910

§ 371 (c)(1),
(2) Date: Dec. 15, 2017

(87) PCT Pub. No.: WO2016/203771

PCT Pub. Date: Dec. 22, 2016

(65) Prior Publication Data

US 2018/0366269 A1 Dec. 20, 2018

(30) Foreign Application Priority Data

Jun. 18, 2015 (JP) ..... 2015-122547

(51) Int. Cl.
*H01F 38/12* (2006.01)

(52) U.S. Cl.
CPC ..... *H01F 38/12* (2013.01); *H01F 2038/122* (2013.01); *H01F 2038/127* (2013.01)

(58) Field of Classification Search
CPC ..... H01F 38/12; H01F 2038/127; H01F 2038/122
See application file for complete search history.

(56) References Cited

U.S. PATENT DOCUMENTS 4,509,495 A * 4/1985 Betz ..... F02P 3/02 123/621
4,658,799 A * 4/1987 Kusaka ..... F02P 3/02 123/622

(Continued)

FOREIGN PATENT DOCUMENTS

EP 0 352 453 A1 1/1990
JP 6-349651 A 12/1994

(Continued)

OTHER PUBLICATIONS

International Search Report for PCT/JP2016/002910 dated Aug. 16, 2016.

(Continued)

*Primary Examiner* — Joseph Dallo
(74) *Attorney, Agent, or Firm* — Sughrue Mion, PLLC

(57) ABSTRACT

An ignition coil includes primary and secondary coils, a center core inserted into a center hole of the primary coil and a center hole of the secondary coil, an annular side core that forms a magnetic circuit through which a first magnetic flux A generated by the primary coil by being joined to the center core permeates, and a permanent magnet that is disposed between the center core and the side core and that emits a second magnetic flux B directed opposite to the first magnetic flux A to apply a magnetic bias. The side core includes protruded portions that protrude towards lateral sides of a T-shaped horizontal portion of the center core, and gaps are provided between the lateral sides of the T-shaped horizontal portion of the center core and the protruded portions of the side core.

6 Claims, 4 Drawing Sheets

(56) References Cited

U.S. PATENT DOCUMENTS

| | | | | |
|---|---|---|---|---|
| 4,903,675 | A * | 2/1990 | Huntzinger | F02P 3/02<br>123/635 |
| 5,015,982 | A * | 5/1991 | Skinner | H01F 27/255<br>336/178 |
| 2011/0304419 | A1 | 12/2011 | Dal Re et al. | |

FOREIGN PATENT DOCUMENTS

| | | | |
|---|---|---|---|
| JP | 2000-311823 | A | 11/2000 |
| JP | 2004-55734 | A | 2/2004 |
| JP | 2006-287090 | A | 10/2006 |
| JP | 2007-103482 | A | 4/2007 |
| JP | 2009-290147 | A | 12/2009 |

OTHER PUBLICATIONS

Extended European Search Report dated Jan. 18, 2019, for Application No. 16811246.4; 8 pages.

* cited by examiner

IGNITION COIL FOR INTERNAL-COMBUSTION ENGINE

CROSS REFERENCE TO RELATED APPLICATIONS

This application is a National Stage of International Application No. PCT/JP2016/002910 filed Jun. 16, 2016 (claiming priority based on Japanese Patent Application No. 2015-122547 filed Jun. 18, 2015), the contents of which are incorporated herein by reference in their entirety.

TECHNICAL FIELD

The present invention relates to an ignition coil for an internal-combustion engine in which a primary current is made to flow through the primary coil, and in which a magnetic flux generated with the above is changed to generate a high-voltage in the secondary coil.

BACKGROUND ART

An ignition coil used in an ignition device of an internal-combustion engine supplies a direct current to a primary coil and excites a high voltage in a secondary coil by conducting and blocking the electric current. In other words, the magnetic flux generated by having the electric current flow through the primary coil is guided to the secondary coil using an iron core and the magnetic flux is changed to generate a high voltage.

In order to have the secondary coil generate a high voltage in an efficient manner, and in order to reduce the size of the ignition coil and put direct ignition into practical use, using a closed magnetic ignition coil is becoming the mainstream in internal-combustion engines.

The closed magnetic ignition coil includes an iron core that constitutes a magnetic circuit through which a magnetic flux generated by a primary coil permeates.

The iron core penetrates a center hole of the primary coil, is extended to an outer peripheral side of the primary coil, is formed in an annular shape so as to connect both winding ends of the primary coil, returns the magnetic flux emitted from the primary coil to the primary coil once more, suppresses the attenuation of the magnetic flux and interlinks with the secondary coil, so that a high voltage is induced efficiently (see PTL 1, for example).

FIG. 4 is an explanatory drawing illustrating a magnetic circuit formed in a conventional ignition coil for an internal-combustion engine. The drawing illustrates a schematic longitudinal section of a conventional ignition coil 100, and the illustration of a secondary coil and the like is omitted in order to clearly illustrate the magnetic circuit and a primary coil.

The ignition coil 100 includes a center core 102 that is inserted into a center hole of a primary coil 101, a side core 103 that is formed so as to surround both lateral sides of the center core 102, and a permanent magnet 104 disposed between a one side portion 103*a* of the side core 103 and the center core 102.

Note that the magnetic circuit described above is formed by the center core 102 and the side core 103.

In the drawing, the center core 102 directly connects an end portion 102*a* on a lower side to the side core 103.

The end portion 102*b* on an upper side of the center core 102 is in contact with a permanent magnet 104 that supplies a bias magnetic field, and forms a magnetic circuit that is connected to the one side portion 103*a* of the side core 103 with the permanent magnet 104 interposed therebetween.

The end portion 102*b* of the center core 102 is formed large so as to obtain a sufficient area in contact with the permanent magnet 104, and the center core 102 is formed in a T-shape. The T-shaped vertical portion is inserted into the center hole of the primary coil 101, and the T-shaped horizontal portion is, as described above, in contact with the permanent magnet 104.

The solid line arrows illustrated in FIG. 4 depict a magnetic flux C generated when a primary current, which is a direct current, flows through the primary coil 101, and the broken line arrows depict the magnetic flux D emitted from the permanent magnet 104.

When the primary current flows through the primary coil 101, the magnetic flux C generated by the primary coil 101 permeates inside the magnetic circuit in the direction indicated by the solid line arrows.

The magnetic flux D depicts the bias magnetic field described above and permeates inside the magnetic circuit in a direction opposite to that of the magnetic flux C.

The magnetic flux C permeating the center core 102 permeates the permanent magnet 104 and reaches the side core 103 (the one side portion 103*a*). Accordingly, a magnetic reluctance caused by the permanent magnet 104 acts on the magnetic flux C.

CITATION LIST

Patent Literature

PTL 1: Japanese Unexamined Patent Application Publication No. 2009-290147

SUMMARY OF INVENTION

Technical Problem

Conventional ignition coils for an internal-combustion engine are configured in the above described manner, and the magnetic path of the permanent magnet that magnetizes the iron core in the opposite direction and the magnetic path of the magnetic path generated by the primary coil overlap each other so as to be formed in the same manner. Accordingly, the magnetic reluctance of the magnetic circuit through which the magnetic flux from the primary coil permeates is dependent on the thickness of the permanent magnet in a magnetization direction.

The permanent magnet needs to have an appropriate thickness to obtain mechanical strength, and it is impossible to form thereof extremely thin. Accordingly, the magnetic circuit has a structural restriction and there is a problem in that there is a limiting value in reducing the size of the magnetic reluctance.

The present invention has been proposed in view of the above situation and an object thereof is to provide an ignition coil for an internal-combustion engine capable of increasing the amount of change in a magnetic flux while sufficiently obtaining a mechanical strength of a permanent magnet.

Solution to Problem

In order to achieve the above object, an ignition coil for an internal-combustion engine according to the present invention includes a primary coil through which a primary current is made to flow, a secondary coil that generates a secondary voltage by intersecting a first magnetic flux generated by the primary coil, a center core inserted into a center hole of the primary coil and a center hole of the secondary coil, an annular side core that surrounds the primary coil and the secondary coil, the side core being joined to the center core and forming a magnetic circuit through which the first magnetic flux permeates, and a permanent magnet that is disposed between the center core and the side core, the permanent magnet emitting a second magnetic flux to the magnetic circuit in a direction opposite to that of the first magnetic flux and applying a magnetic bias, in which the side core includes a protruded portion that protrudes towards a lateral side of an end portion of the center core joined to the permanent magnet, in which a gap is provided between the lateral side of the end portion of the center core and the protruded portion of the side core, and in which the gap is provided so that a magnetic reluctance when the gap serves as a magnetic path is smaller than a magnetic reluctance when the permanent magnet serves as a magnetic path of the first magnetic flux.

Furthermore, the center core is formed in a T-shape that includes a vertical portion that is inserted into the center hole of the primary coil and the center hole of the secondary coil, and a horizontal portion in which an end portion joined to the permanent magnet is provided so as to extend in a vertical direction with respect to the vertical portion. A gap is formed by opposing an end portion of the horizontal portion and the protruded portion of the side core.

Furthermore, a resin member is disposed between the lateral side of the end portion of the center core and the protruded portion of the side core to fill the gap.

Furthermore, a flange portion in a tubular core member around which the primary coil is wound and that is formed of the resin member is included, the horizontal portion of the center core and the flange portion are joined to each other by inserting the vertical portion of the center core into the center hole of the core member, and the end portion of the flange portion is interposed between the end portion of the horizontal portion and the protruded portion of the side core by mounting the side core from an outer side of the flange portion.

Advantageous Effects of Invention

According to present invention, the magnetic reluctance may be made small, the amount of change in the magnetic flux in the closed magnetic path can be made large, and the secondary voltage can be induced efficiently.

DESCRIPTION OF EMBODIMENTS

Hereinafter, an embodiment of the invention will be described with reference to the drawings.

Figure 1:
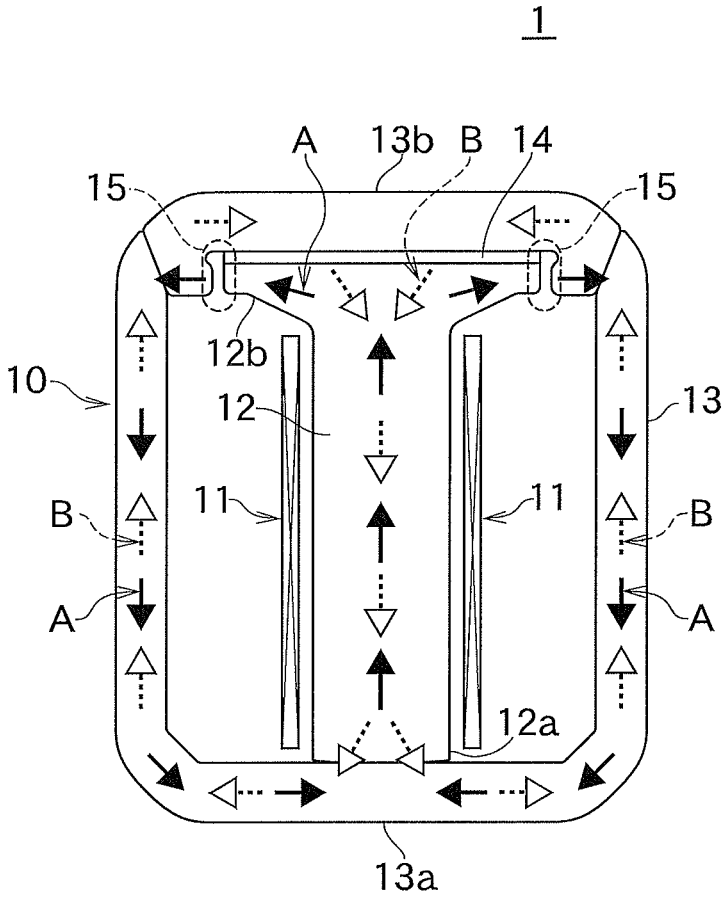
FIG. 1 is an explanatory drawing illustrating a schematic configuration of an ignition coil for an internal-combustion engine according to an embodiment of the present invention.

FIG. 1 is an explanatory drawing illustrating a schematic configuration of an ignition coil for an internal-combustion engine according to the embodiment of the present invention. The drawing illustrates a schematic longitudinal section of an ignition coil 1, and the illustration of a secondary coil and the like is omitted in order to clearly illustrate a magnetic circuit and a primary coil.

The ignition coil 1 includes an iron core 10, a primary coil 11, a permanent magnet 14 and the like. The iron core 10 includes a center core 12 formed in a T-shape, and a side core 13 formed in an annular shape.

The primary coil 11 is, for example, a cylindrically-shaped core member around which a length of winding wire has been wound, and a T-shaped vertical portion 12*a* of the center core 12 is inserted into a tubular center hole. Note that the secondary coil described above is also a cylindrically-shaped core member around which a length of winding wire has been wound. Furthermore, core members of the primary coil 11 and the secondary coil and the like are, for example, formed using a resin material and the like.

A T-shaped horizontal portion 12*b* of the center core 12 is exposed from the center hole of the primary coil 11 and is in contact with the permanent magnet 14.

The permanent magnet 14 is, for example, formed in a flat plate shape, and has a width or a diameter that is the same as that of the T-shaped horizontal portion 12*b* of the center core 12, and the upper and lower end portions (end surfaces) in the drawing are magnetic poles. Note that in the permanent magnet 14 exemplified herein, an N-pole (the lower end surface) is in contact with the center core 12 and an S-pole (the upper end surface) is in contact with the side core 13.

Figure 2:
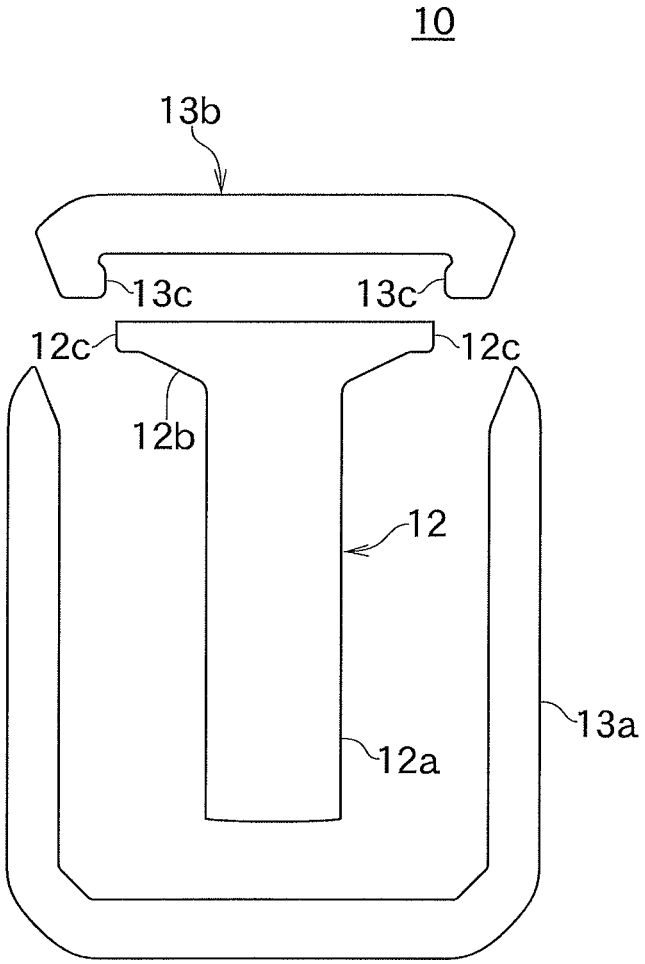
FIG. 2 is an explanatory drawing illustrating a schematic configuration of an iron core in FIG. 1.

FIG. 2 is an explanatory drawing illustrating a schematic configuration of the iron core in FIG. 1. The drawing illustrates an exemplary configuration of the iron core 10 and, similar to FIG. 1 when the winding lateral surface of the primary coil 11 is viewed from the front, illustrates each of the shapes of the T-shaped center core 12 and the annularly-shaped iron core 13.

The side core 13 is formed of a magnetic material similar to that of the center core 12, is formed of two members, namely, a substantially U-shaped first side core 13*a* and a substantially I-shaped second side core 13*b*, for example, and is configured so as to become annular by joining the above members together.

Note that the center core 12, the first side core 13*a*, and the second side core 13*b* are formed by stacking a plurality of sheet irons having the illustrated shapes, for example.

In the second side core 13*b*, a magnetic pole portion of the permanent magnet 14 described above is in contact with a portion that is an inner side of the annular shape.

In the center core 12, an upper end of a longitudinal portion of the T-shaped horizontal portion 12*b*, serving as a magnetic path that includes the permanent magnet 14, is connected to the second side core 13*b*.

Each of the second side core 13*b* includes, at both ends in the longitudinal direction of the second side core 13*b*, protruded portions 13*c* that are disposed so as to oppose the lateral ends 12*c* in the longitudinal direction of the corresponding T-shaped horizontal portion 12*b* when, as described above, the T-shaped horizontal portion 12*b* of the center core 12 is connected to the second side core 13*b* with the permanent magnet 14 interposed therebetween.

The iron core 10 is provided with gaps 15 illustrated in FIG. 1 between the protruded portions 13*c* of the second side core 13*b* and the lateral ends 12*c* of the T-shaped horizontal portion 12*b*. In other words, as illustrated in FIG. 1, the gaps 15 are provided at the sides of the permanent magnet 14 and in the vicinities of a portion joining the permanent magnet 14 and the center core 12 to each other.

The protruded portions 13*c* are formed so as to protrude towards the inner side of the annular shape of the side core 13. Specifically, as illustrated in FIG. 1 for example, the protruded portions 13*c* are, in a state in which the T-shaped horizontal portion 12*b* is connected to the second side core 13*b* with the permanent magnet 14 interposed therebetween, formed so as to be closer to the lateral ends 12*c* of the T-shaped horizontal portion 12*b* with respect to the end portions of the permanent magnet 14 at the sides.

In particular, when increasing the energy efficiency of the gasoline engine, the inside of the combustion chamber is made high in airflow, high in compression, and the like and, accordingly, a high ignition energy is required.

Accordingly, closed magnetic circuit ignition coils are used frequently in high efficiency gasoline engines.

There is a closed magnetic circuit ignition coil including a permanent magnet inside a magnetic circuit to achieve both reduction in size and high output at the same time.

Note that a residual magnetic flux density of a permanent magnet is 1 to 1.4 tesla (hereinafter, denoted as [T]), and, in a case in which such a permanent magnet is incorporated in the magnetic circuit, the magnetic flux density emitted to the magnetic circuit is about 0.7 [T].

The largest saturation magnetic flux density of a silicon sheet, for example, that is used in an iron core 10 and the like is about 2.1 [T], and the largest magnetic flux density in an area in which the magnetizing force acts in a linear manner is about 1.7 [T].

In order to have the bias magnetic force emitted from the permanent magnet act in a highly efficient manner, the ratio between the cross-sectional area of the iron core and the cross-sectional area of the permanent magnet, which serve as a magnetic path, is about 1:2.4, for example, in other words, it is configured such that the cross-sectional area of the permanent magnet is about 2.4 times the cross-sectional area of the iron core. By configuring the magnetic path in the above manner, the iron core that is directly joined to the permanent magnet is magnetized to about 1.7[T].

The ignition coil 1 illustrated in FIG. 1 is configured so that the center core 12 directly joined to the permanent magnet 14 is, as described above, magnetized to about 1.7 [T] in an opposite direction (an opposite direction with respect to a magnetic flux A generated by the primary coil 11).

In other words, for example, in a case in which the iron core 10 is constituted by a silicon sheet, the sizes and the shapes of the center core 12 and the permanent magnet 14 are set such that the cross-sectional area of the permanent magnet 14 is about 2.4 times the cross-sectional area of the T-shaped vertical portion 12*a* so that a magnetic flux density of a magnetic flux B permeating the T-shaped vertical portion 12*a* of the center core 12 is 1.7 [T].

Note that the T-shaped horizontal portion 12*b* of the center core 12 is formed so that an upper end is enlarged to absorb substantially all of the magnetic flux B emitted from the permanent magnet 14, and the enlarged upper end portion is, for example, formed in the same shape and size as those of the joined end portion of the magnetic pole of the permanent magnet 14. Note that the shape of the upper end portion of the T-shaped horizontal portion 12*b* is not limited to being similar to that of the permanent magnet 14.

The solid line arrows illustrated in FIG. 1 depict the magnetic flux A generated when a primary current, which is a direct current, flows through the primary coil 11, and the broken line arrows depict the magnetic flux B emitted from the permanent magnet 14.

The magnetic flux B is emitted from a lower side surface of the permanent magnet 14 in the drawing to the T-shaped horizontal portion 12*b*. In the above, since the gaps 15 are provided and the lateral ends 12*c* of the T-shaped horizontal portion 12*b* are not in direct contact with the second side core 13*b*, the magnetic flux B emitted to the T-shaped horizontal portion 12*b* permeates the T-shaped vertical portion 12*a*, and proceeds to the first side core 13*a* through a lower end of the T-shaped vertical portion 12*a* in the drawing.

Subsequently, the magnetic flux B is separated into the left and right in the drawing and permeates the first side core 13*a*, and proceeds towards each of the end portions of the second side core 13*b* in the longitudinal direction (the portions joining the first side core 13*a* and the second side core 13*b* to each other).

As described above, the magnetic flux B permeates the center core 12 and the side core 13, and returns to a magnetic pole (S pole) portion of the permanent magnet 14 through an area that is the inner side of the annular shape of the second side core 13*b*.

The magnetic flux B is directed opposite with respect to the magnetic flux A described later and establishes a magnetic bias applied by the permanent magnet 14 in the magnetic circuit that is constituted by the center core 12 and the side core 13.

The magnetic flux A permeates each of the portions (the magnetic circuit) of the center core 12 and the side core 13 in the following manner when the primary current, which is a direct current, flows through the primary coil 11.

Most of the magnetic flux A generated around the primary coil 11 is focused to the center core 12 inserted through the center hole of the primary coil 11 and the center hole of the secondary coil, illustration of which has been omitted and, for example, permeates the center core 12 towards the T-shaped horizontal portion 12*b* side from the T-shaped vertical portion 12*a* side. Furthermore, in the magnetic flux A around the primary coil 11 described above, the flux radiated to the outer peripheral side of the primary coil 11 is focused to the side core 13 and, as described later, permeates the side core 13 and the center core 12.

In order to avoid the route having a relatively large magnetic reluctance, most of the magnetic flux A that permeates the center core 12 does not permeate the permanent magnet 14 and proceeds to both end portions (the lateral ends 12*c*) of the T-shaped horizontal portion 12*b* in the longitudinal direction, permeates the gaps 15, and reaches the protruded portions 13*c* of the second side core 13*b*.

Compared with the magnetic reluctance when the gaps 15 serve as the magnetic path, since the magnetic reluctance is larger when the permanent magnet 14 serves as the magnetic path, the magnetic flux A permeates the magnetic path including the gaps 15 (not including the permanent magnet 14) as described above.

In other words, the gaps 15 are configured so that the magnetic reluctance when the gaps 15 serve as the magnetic path is smaller than the magnetic reluctance when the permanent magnet 14 serves as the magnetic path.

Specifically, the intervals of the gaps 15, that is, the distance length between lateral ends 12*c* and the protruded portions 13*c*, the area of the area in which each lateral end 12*c* and the corresponding protruded portion 13*c* oppose each other (the cross-sectional area of the magnetic path), the magnetic permeability between the lateral ends 12*c* and the protruded portions 13*c*, and the like are set so that the size of the magnetic reluctance is as described above, and each of the portions are configured so that the above setting is achieved.

Furthermore, the magnetic reluctance of each of the gaps 15 described above set larger than the magnetic reluctance of the magnetic circuit (that connects the magnetic poles of the permanent magnet 14) constituted by the side core 13 and the like, so that most of the magnetic flux B does not permeate the gaps 15.

The magnetic flux A proceeds from the protruded portions 13*c* described above to the portions joining the second side core 13*b* and the first side core 13*a* to each other, permeates the first side core 13*a*, proceeds from the substantially U-shaped center portion to the lower end of the center core 12, that is, a distal end portion of the T-shaped vertical portion 12*a*, and returns to the T-shaped vertical portion 12*a*, the primary coil 11, and the like. As described above, the magnetic flux A circulates in a magnetic circuit that avoids the permanent magnet 14.

The gaps 15 described above may be an air gap in which the magnetic flux A permeates though air; however, for example, a portion of a cover member that covers the core member (a bobbin) of the primary coil 11 or the surface of each iron core, or a coating member that coats the surface of each iron core described above, which are formed of a material such as a resin, or a coating material that coats the surface of each iron core may be inserted or filled therein. With such a configuration, the mechanical strength in the vicinities of the gaps 15 can be increased and the shock resistance of the ignition coil 1 is improved.

When the ignition coil 1 is assembled, for example, the permanent magnet 14 is mounted on the upper end portion of the T-shaped horizontal portion 12*b* of the center core 12. The center core 12 is inserted from the lower end portion of the T-shaped vertical portion 12*a* into the center hole of the tubular core member around which the primary coil 11 has been wounded.

In the above, in a case in which the upper end of the core member of the primary coil 11 is a flange portion that bulges out in a radial direction of the core member, and the center core 12 is inserted into the core member center hole, the core member of the primary coil 11 described above is formed so that the T-shaped horizontal portion 12*b* is mounted on the flange portion described above.

The core member center hole described above is disposed and configured to position the center core 12 and, specifically, performs positioning so that the center core 12 is not deviated to either direction and, furthermore, is formed in a shape that supports and fixes the T-shaped vertical portion 12*a*, for example.

Furthermore, the flange portion of the core member described above includes, at an upper end portion thereof, a recess portion (or a groove portion, or the like) that engages or fits into the T-shaped horizontal portion 12*b* of the center core 12 and the permanent magnet 14, for example, and is configured so as to position and fix the T-shaped horizontal portion 12*b* and the permanent magnet 14. Note that when the T-shaped horizontal portion 12*b* is joined to the flange portion, the upper end surface (the magnetic pole portion) of the permanent magnet 14 is exposed from the upper surface of the flange portion.

The flange portion described above protrudes from the outer periphery of the primary coil 11 towards the radially outer side and, for example, is formed so as to cover the entire T-shaped horizontal portion 12*b* including the lateral ends 12*c*, in other words, is formed so as to embed the T-shaped horizontal portion 12*b*. Furthermore, the upper end portion of the flange portion is formed so as to be in contact (to adhere, for example) with the area that is to be the inner side of the annular shape of the second side core 13*b*.

As described above, after the center core 12 is inserted into the core member center hole of the primary coil 11, and the T-shaped horizontal portion 12*b*, the permanent magnet 14, and the like are fixed, the second side core 13*b* is mounted on the permanent magnet 14 and a portion on the outer side (the upper side in FIG. 1, and the like) of the core member flange portion.

As described above, after the second side core 13*b* is joined to the flange portion, the permanent magnet 14, and the like, each end portion of the first side core 13*a* is joined to the lower end portions of the two end portions of the second side core 13*b* in the longitudinal direction in FIGS. 1, 2, and the like.

As described above, the second side core 13*b* includes the protruded portions 13*c* at the longitudinal two ends thereof, and is formed so as to oppose the lateral ends 12*c* of the T-shaped horizontal portion 12*b*. When the second side core 13*b* is joined to the permanent magnet 14, since, as described above, the lateral ends 12*c* of the T-shaped horizontal portion 12*b* is covered by the flange portion, a lateral end portion of the flange portion is interposed between the lateral ends 12*c* and the protruded portions 13*c* so that a portion of the core member is inserted or filled in the gaps 15.

In other words, by having the core member described above position the center core 12 and the second side core 13*b*, and the lateral end portion of the flange portion be interposed between the gaps 15, the intervals inside the gaps 15 are set at a predetermined distance with a satisfactory accuracy. Accordingly, deviation and the like in the positional relationship between the iron cores and in the gaps 15 can be prevented, deflection and variation can be suppressed in the small magnetic reluctance value, and the output performance and the like of the ignition coil 1 can be made stable. Furthermore, a decrease in the output voltage (secondary voltage) of the ignition coil 1 can be suppressed to the extent possible in a case in which, for example, the battery voltage is small and obtaining a sufficient primary current is difficult when the magnetic reluctance is reduced in the magnetic circuit of the magnetic flux A, and in a case during a high rotation operation of the internal-combustion engine in which the energizing time of the primary current is short.

Figure 3:
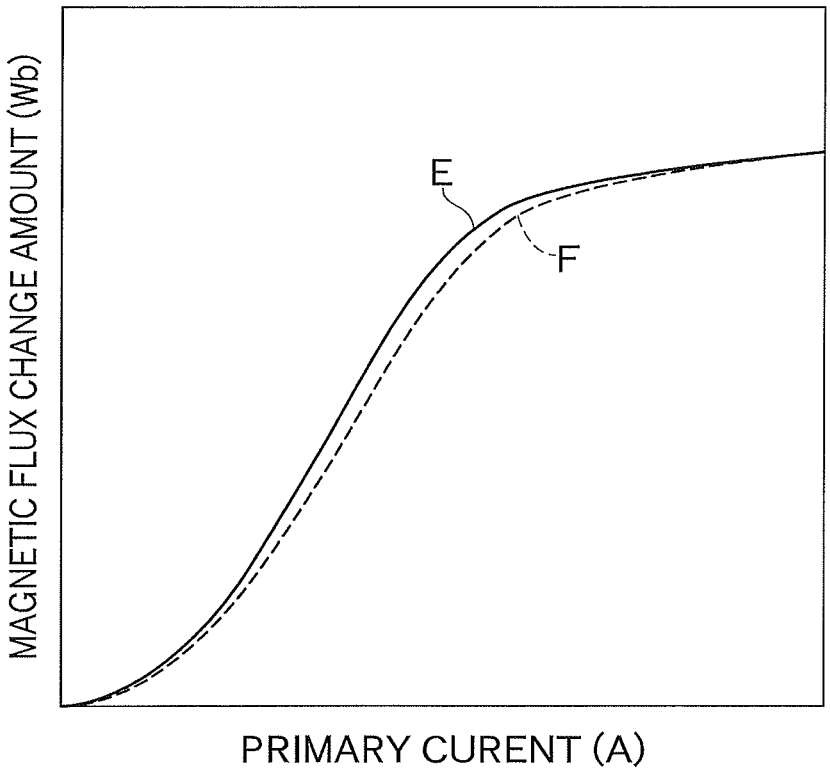
FIG. 3 is an explanatory drawing illustrating magnetization characteristics of a magnetic circuit formed in an ignition coil.

FIG. 3 is an explanatory drawing illustrating magnetization characteristics of a magnetic circuit formed in an ignition coil. In the drawing, the axis of ordinate indicates the amount of change in the magnetic flux generated by the primary coil, specifically, the magnetic flux that permeates the magnetic circuit when the primary current flowing through the primary coil is conducted and blocked. Note that the axis of abscissa indicates the size (the value during conduction) of the primary current made to flow through the primary coil.

Figure 4:
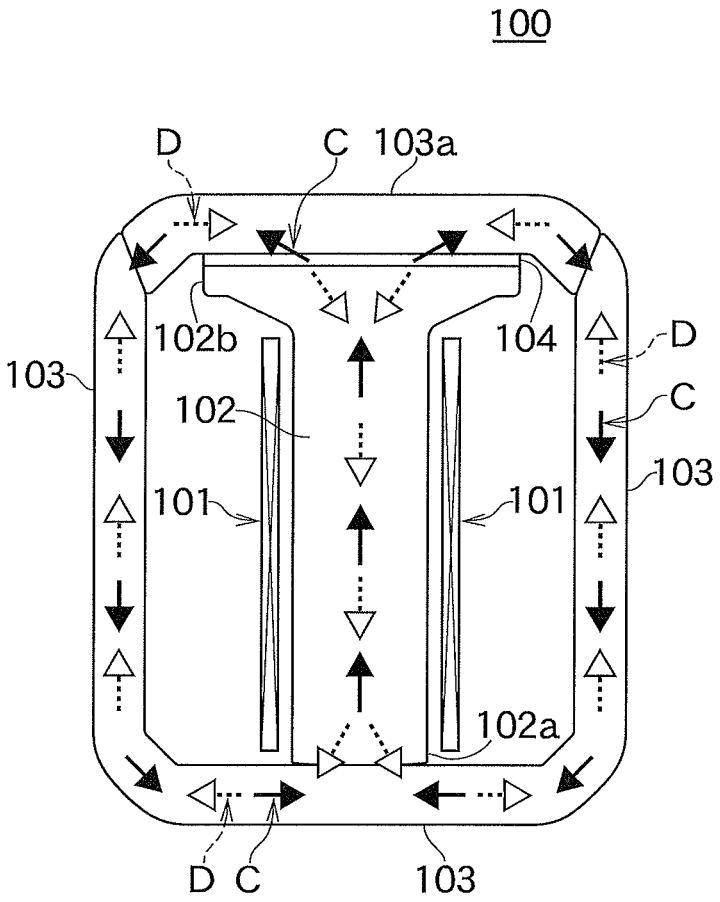
FIG. 4 is an explanatory drawing illustrating a magnetic circuit formed in a conventional ignition coil for an internal-combustion engine.

In the drawing, a characteristic curve E in a solid line illustrates a characteristic when the gaps 15 described above have been provided between the center core 12 and the side core 13, and the characteristic curve F in a broken line illustrates a characteristic when the gaps 15 are not provided, for example, when the iron core illustrated in FIG. 4 is used. Note that the characteristic curves illustrate characteristics of the ignition coils configured in a similar manner except for the presence of the gaps 15.

By comparing the characteristic curve E and the characteristic curve F with each other, it is understood that the amount of change in the magnetic flux caused by the conduction and blockage of the primary current becomes larger when a bypass route of the magnetic flux A generated by the primary coil 11 is provided, in other words, when the gaps 15 are provided as a magnetic path that avoids the permanent magnet 14. In other words, by providing the gaps 15, the thickness of the permanent magnet 14 in a magnetization direction can be suppressed from affecting the magnetic reluctance.

In other words, the magnetic reluctance acting on the magnetic flux A can be reduced without reducing the thickness of the permanent magnet 14 and, furthermore, the magnetic reluctance can be adjusted as well by setting appropriate values to the intervals of the gaps 15, the cross-sectional area, the magnetic permeability of the magnetic path in the gaps 15 and the like.

As described above, according to the present embodiment, even in a configuration in which the magnetic bias in the opposite direction is applied to the magnetic circuit, the magnetic flux generated by the primary coil can permeate the magnetic path with a small magnetic reluctance, and the efficiency in generating the secondary voltage can be increased.

REFERENCE SIGNS LIST

1 ignition coil
10 iron core
11 primary coil
12 center core
13 side core
13*a* first side core
13*b* second side core
14 permanent magnet
15 gap
100 ignition coil
101 primary coil
102 center core
102*a* end portion
102*b* end portion
103 side core
103*a* one side portion
104 permanent magnet

The invention claimed is:

1. An ignition coil for an internal-combustion engine comprising:

a primary coil through which a primary current is made to flow;

a secondary coil that generates a secondary voltage by intersecting a first magnetic flux generated by the primary coil;

a center core inserted into a center hole of the primary coil and a center hole of the secondary coil;

an annular side core that surrounds the primary coil and the secondary coil, the annular side core being joined to the center core and forming a magnetic circuit through which the first magnetic flux permeates; and a permanent magnet that is disposed between the center core and the side core, the permanent magnet emitting a second magnetic flux to the magnetic circuit in a direction opposite to that of the first magnetic flux and applying a magnetic bias;

wherein the side core includes a protruded portion that protrudes towards a lateral side of an end portion of the center core joined to the permanent magnet, wherein a gap is provided between the lateral side of the end portion of the center core and the protruded portion of the side core, and wherein the gap is provided so that a magnetic reluctance when the gap serves as a magnetic path is smaller than a magnetic reluctance when the permanent magnet serves as a magnetic path of the first magnetic flux.

2. The ignition coil for an internal-combustion engine according to claim 1, wherein the center core is formed in a T-shape that includes a vertical portion that is inserted into the center hole of the primary coil and the center hole of the secondary coil, and a horizontal portion in which an end portion joined to the permanent magnet is provided so as to extend in a vertical direction with respect to the vertical portion, and wherein a gap is formed by opposing an end portion of the horizontal portion and the protruded portion of the side core.

3. The ignition coil for an internal-combustion engine according to claim 1, wherein a resin member is disposed between the lateral side of the end portion of the center core and the protruded portion of the side core to fill the gap.

4. The ignition coil for an internal-combustion engine according to claim 3, further comprising:

a flange portion in a tubular core member around which the primary coil is wound and that is formed of the resin member, wherein the horizontal portion of the center core and the flange portion are joined to each other by inserting the vertical portion of the center core into the center hole of the core member, and the end portion of the flange portion is interposed between the end portion of the horizontal portion and the protruded portion of the side core by mounting the side core from an outer side of the flange portion.

5. The ignition coil for an internal-combustion engine according to claim 2, wherein a resin member is disposed between the lateral side of the end portion of the center core and the protruded portion of the side core to fill the gap.

6. The ignition coil for an internal-combustion engine according to claim 5, further comprising:

a flange portion in a tubular core member around which the primary coil is wound and that is formed of the resin member, wherein the horizontal portion of the center core and the flange portion are joined to each other by inserting the vertical portion of the center core into the center hole of the core member, and the end portion of the flange portion is interposed between the end portion of the horizontal portion and the protruded portion of the side core by mounting the side core from an outer side of the flange portion.

* * * * *